US005454655A

United States Patent [19]

Chiswell

[11] Patent Number: 5,454,655

[45] Date of Patent: Oct. 3, 1995

[54] RETRACTING WRITING INSTRUMENT HAVING REPLACEABLE CARTRIDGE

[75] Inventor: Edgar B. Chiswell, Greenville, S.C.

[73] Assignee: BIC Corporation, Milford, Conn.

[21] Appl. No.: 158,721

[22] Filed: Nov. 29, 1993

Related U.S. Application Data

[63] Continuation of Ser. No. 937,298, Aug. 28, 1992, abandoned.

[51] Int. Cl.[6] ..... B43K 7/12; B43K 24/04; B43K 24/08; B43K 25/00

[52] U.S. Cl. ..... 401/104; 401/106

[58] Field of Search ..... 401/104, 105, 401/106, 209

[56] References Cited

U.S. PATENT DOCUMENTS

| | | | |
|---|---|---|---|
| D. 321,207 | 10/1991 | Granoff . | |
| 1,583,718 | 5/1926 | Hudson . | |
| 3,037,483 | 6/1962 | Caviglione | 401/104 |
| 3,164,132 | 1/1965 | Ganz . | |
| 3,637,316 | 1/1972 | Bross | 401/104 |
| 3,797,945 | 3/1974 | Zepell . | |
| 3,920,337 | 11/1975 | Ganz | 401/106 |
| 4,185,933 | 1/1980 | Zepell . | |
| 4,221,490 | 9/1980 | Malm . | |
| 4,551,034 | 11/1985 | Zepell . | |
| 4,551,035 | 11/1985 | Baker et al. . | |
| 4,790,678 | 12/1988 | Araki . | |
| 4,837,900 | 6/1989 | Boyce et al. . | |
| 4,973,179 | 11/1990 | Nakazato et al. . | |
| 4,981,382 | 1/1991 | Murphy . | |
| 4,995,750 | 2/1991 | Akita . | |
| 5,074,694 | 12/1991 | Nakazato et al. . | |

FOREIGN PATENT DOCUMENTS

| | | | |
|---|---|---|---|
| 251428 | 4/1964 | Australia | 401/104 |
| 1118319 | 6/1956 | France | 401/104 |
| 67718 | 3/1958 | France | 401/104 |
| 95264 | 10/1959 | Norway | 401/209 |
| 881087 | 11/1961 | United Kingdom | 401/104 |
| 979882 | 1/1965 | United Kingdom | 401/104 |

*Primary Examiner*—Steven A. Bratlie
*Attorney, Agent, or Firm*—Rocco S. Barrese; Peter G. Dilworth; Joseph J. Catanzaro

[57] ABSTRACT

A writing instrument which includes a body having a barrel portion and a replaceable cartridge housed within the barrel portion. A retractor mechanism is removably maintained in a rear end of the barrel portion and is adapted for axial movement between a retracted position and a protracted position. The instrument further includes structure for biasing the replaceable cartridge toward the rear end of the barrel portion and for maintaining the retractor mechanism in the protracted position by imparting a moment, or force, on the retractor mechanism acting relative to the axial centerline of the barrel portion.

19 Claims, 4 Drawing Sheets

RETRACTING WRITING INSTRUMENT HAVING REPLACEABLE CARTRIDGE

This is a continuation of application Ser. No. 07/937,298 filed on Aug. 28, 1992, now abandoned.

BACKGROUND OF THE INVENTION

1. Field of the Invention

This invention is related to writing instruments, and more particularly to a rechargeable writing instrument, having a unique retractor mechanism which provides for greater convenience and ease in use and greater efficiency in manufacturing than known retractor mechanisms.

2. Discussion of Related Art

Writing instruments having a retracting cartridge element disposed in an elongated barrel are well known in the art. Examples of such writing instruments include: U.S. Pat. Nos. 4,995,750; 4,551,035; and 3,637,316. These instruments generally comprise a retractor mechanism having integral biasing means for maintaining the retractor mechanism in a fixed position corresponding to the cartridge being protracted from the barrel. Such retractor mechanisms can have resilient spring portions which may be forcibly deformed for moving the cartridge from the protracted position to a retracted position within the barrel of the writing instrument. However, over time, and after repeated operations, the resilient spring portions of such mechanisms can fatigue and eventually fail. In addition, these retractor mechanisms are designed in such a manner so that recharging can become a difficult task, requiring great dexterity and a considerable amount of time.

It is desirable therefore, to provide a retractable writing instrument having a removable plunger mechanism which can be easily disassembled from the barrel of the instrument so that a spent writing cartridge can be quickly replaced.

SUMMARY OF THE INVENTION

The writing instrument of the subject invention essentially comprises an elongated body having a barrel portion and a retracting plunger mechanism. The barrel portion has opposed front and rear ends and is adapted for housing a replaceable cartridge. As discussed herein for purposes of continuity, all references to the "front" end of the barrel portion refers to the end at which the writing tip is disposed, while any reference to the "rear" end of the barrel portion of the writing instrument relates to the end at which the retracting plunger mechanism is disposed.

The retracting plunger mechanism is removably maintained in the rear end of the barrel portion and is adapted for axial movement between a first position corresponding to the cartridge being retracted within the front end of the barrel portion and a second position corresponding to the cartridge being protracted from the front end of the barrel portion. When in the second position, the retracting plunger mechanism is in a locked condition. Means are provided for biasing the cartridge toward the rear end of the barrel portion while maintaining the retracting plunger mechanism in a locked condition by imparting a moment, or force, on the plunger mechanism which is created by a portion of the cartridge acting on the plunger mechanism relative to the axial centerline of the barrel portion.

The retracting plunger mechanism is preferably monolithically formed and includes a body portion, an elongated clip portion depending from the body portion, and latch means associated with the clip portion for engaging the barrel portion of the writing instrument when the plunger mechanism is in the second position. In a preferred embodiment of the writing instrument, the body portion of the retracting plunger mechanism includes means for engaging an end portion of the replaceable cartridge. The engaging means is adapted for maintaining the rear end portion of the cartridge in a deflected position which is spaced from the axial centerline of the barrel portion. Preferably, the engaging means comprises a projection which extends from the body portion of the retracting plunger mechanism.

The biasing means preferably comprises a coiled compression spring disposed adjacent the front end of the barrel portion for urging the cartridge toward the rear end of the barrel portion. The coiled spring and the engaging means on the retractor mechanism cooperate in such a manner so as to maintain the retracting plunger mechanism in the second position by imparting a moment, or force, upon the plunger mechanism which is created as the cartridge is deflected from the axial centerline of the barrel. The cartridge transmits the spring force to an upward force on the rear end of the plunger and a corresponding downward force on the latch means of the clip. The downward force on the latch means engages the latch means with the barrel to hold the cartridge in the retracted or protracted position.

In the preferred embodiment of the invention, the barrel portion of the writing instrument includes a slotted portion for engaging the latch means of the clip portion when the retracting plunger mechanism is in the second position. The barrel portion further includes a longitudinally extending port for mounting the retracting plunger mechanism. The mounting port is dimensioned and configured for permitting both axial and pivotal movement of the retracting plunger mechanism relative to the barrel portion of the writing instrument. In addition, the mounting port is configured for facilitating ease of assembly and disassembly of the writing instrument for replacing spent writing cartridges.

BRIEF DESCRIPTION OF THE DRAWINGS

Further features of the invention will become more apparent from the accompanying drawings and the following detailed description of the subject invention. Preferred embodiments of the subject invention will be described hereinbelow with reference to the drawings wherein.

DETAILED DESCRIPTION OF THE PREFERRED EMBODIMENT

Figure 1:
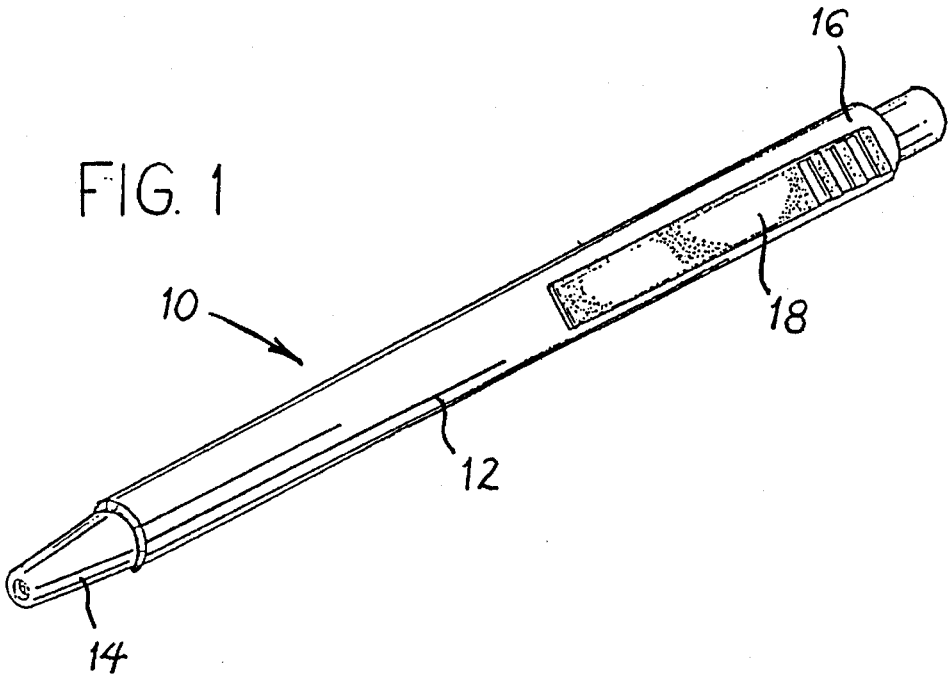
FIG. 1 is a perspective view of a writing instrument in accordance with a preferred embodiment of the subject invention with the writing cartridge in the retracted position.
Figure 2:
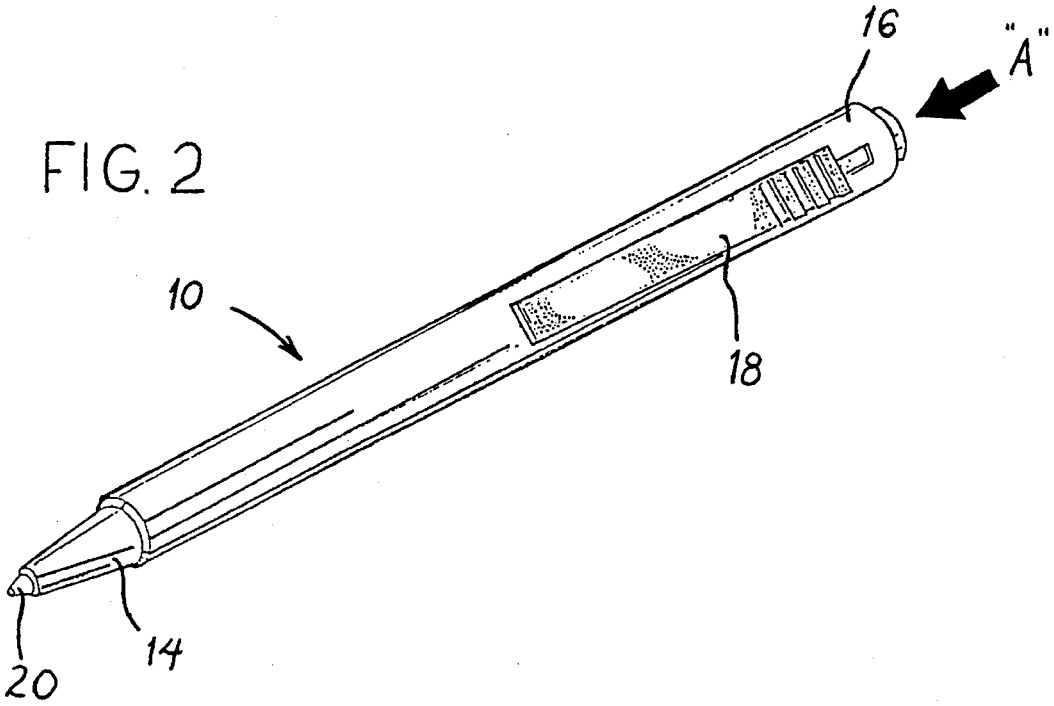
FIG. 2 is a perspective view of the writing instrument of FIG. 1 with the writing cartridge in a protracted position.

Referring now in detail to the drawings, in which like reference numerals identify similar or identical elements, a preferred embodiment of the writing instrument of the subject invention is illustrated in FIGS. 1 and 2 and is designated generally by reference numeral 10.

Writing instrument 10 comprises an elongated barrel portion 12 having opposed front and rear ends 14 and 16. A retracting plunger mechanism 18 is removably maintained adjacent the rear end 16 of barrel portion 12. The retracting plunger mechanism 18 is adapted for axial movement between a first position as shown in FIG. 1 wherein a replaceable cartridge 20 is retracted within the front end 14 of the barrel portion 12 and a second position as shown in FIG. 2 corresponding to the cartridge 20 being protracted from the front end 14 of the barrel portion 12.

Figure 3:
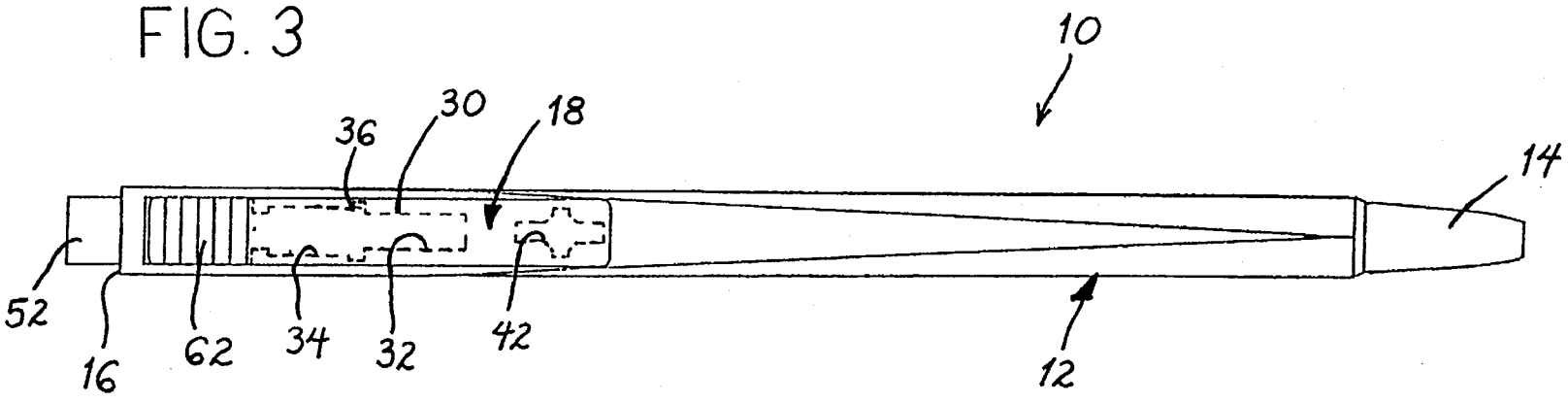
FIG. 3 is a top plan view of the writing instrument of FIG. 1.
Figure 4:
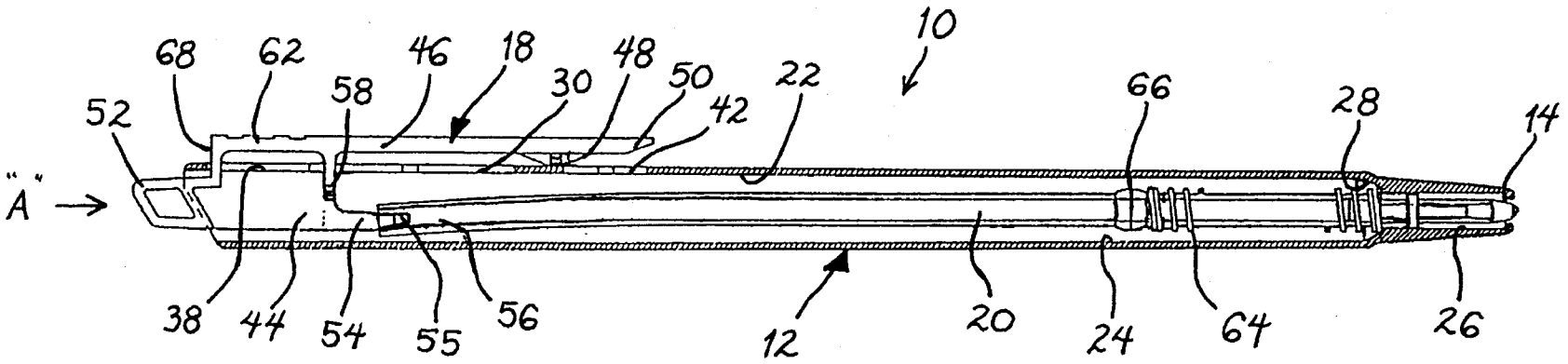
FIG. 4 is a side cross-sectional view of the writing instrument of FIG. 1, with the writing cartridge in a retracted position.

Turning now to FIGS. 3 and 4, the barrel portion 12 of writing instrument 10 has an elongated and stepped axial bore 22 extending therethrough. The stepped axial bore 22 includes a major portion 24 and a minor portion 26 being separated by an intermediate wall 28 formed adjacent the front end 14 of barrel portion 12. Alternatively, the intermediate wall 28 could be defined as a ridge, while the major portion 24 and the minor portion 26 would have a constant diameter and the outside of the barrel portion 12 would be tapered. A longitudinally extending mounting port 30 is provided in barrel portion 12 adjacent the rear end 16 thereof for releasably mounting the retracting plunger mechanism 18. Mounting port 30 includes a forward dismounting area 32, an intermediate operational area 34 which includes a notched section 36, and a rearward mounting area 38 having a trailing edge 40. A locking slot 42 is formed in the barrel portion 12 spaced forwardly from the mounting port 30. Locking slot 42 is adapted for lockingly engaging a portion of the retracting plunger mechanism 18 when the retracting mechanism 18 is in the second position. Alternatively, a locking slot may be provided in a portion of the retracting plunger mechanism 18 which would be adapted for lockingly engaging a detent which would extend radially outward from the barrel portion 12.

Figure 5:
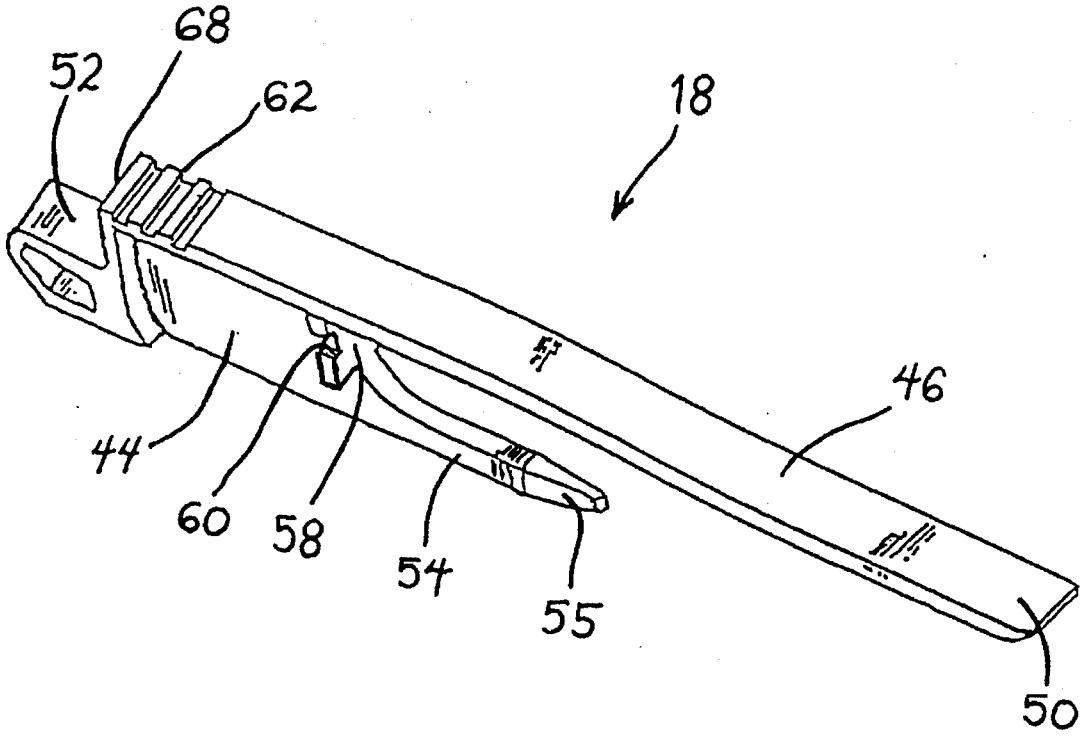
FIG. 5 is a perspective view of the retracting plunger mechanism of the writing instrument of FIG. 1.
Figure 6:
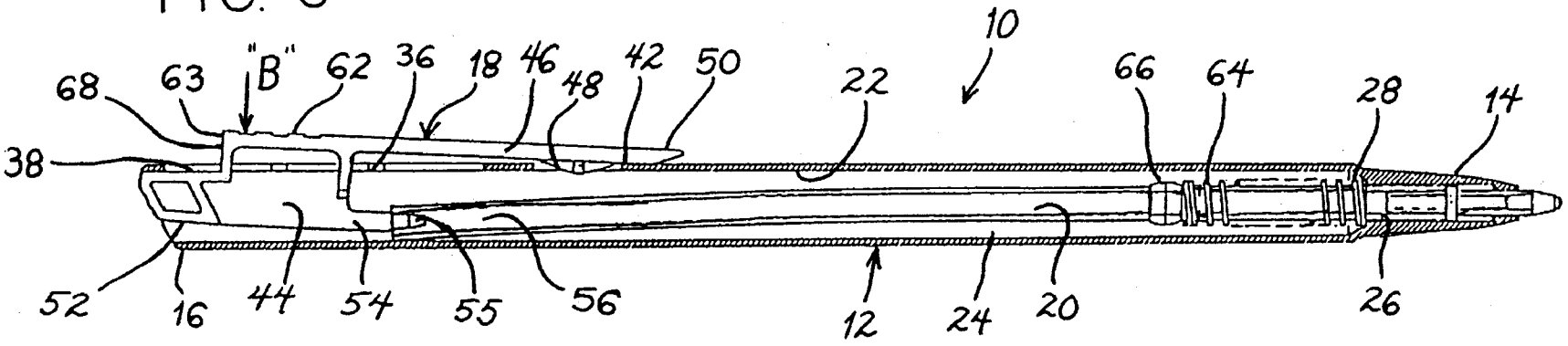
FIG. 6 is a side cross-sectional view of the writing instrument of FIG. 1, with the writing cartridge in a protracted position.

As seen in FIGS. 4 and 5, the retracting plunger mechanism 18 includes a body portion 44, a clip portion 46 extending unitarily from the body portion 44, and a latching detent 48 disposed adjacent the forward end 50 of clip portion 46, for lockingly engaging the locking slot 42 in the barrel portion 12 of writing instrument 10. As stated hereinabove, it is envisioned that the latching detent 48 may be replaced by a locking slot for engaging a corresponding detent on the barrel portion 12. The body portion 44 of the retracting plunger mechanism 18 includes a push button portion defined at the rear end 52 thereof for finger actuation. An elongated projection 54 extends forwardly from the body portion 44 and includes a tapered front end 55 adapted for engagement in the rear end 56 of writing cartridge 20 as best seen in FIG. 6. The elongated projection 54 is positioned in such a manner so that upon engaging the rear end 56 of writing cartridge 20, the rear end portion 56 is deflected and maintained in a position which is spaced from the axial centerline of the barrel portion 12 of the writing instrument 10 as best seen in FIGS. 4 and 6. The body portion 44 of the retracting plunger mechanism 18 further includes a transverse wall 58 which has opposed notches 60 arranged for engaging the area of the barrel portion 12 which defines the periphery of mounting slot 30. The opposed notches 60 are configured and adapted for enabling both axial and pivotal movement of the retracting plunger mechanism 18 relative to the barrel portion 12 of writing instrument 10. In addition, the clip portion 46 of retractor mechanism 18 includes a plurality of transverse striations 62 formed proximate the rear end 63 thereof for assisting in finger manipulation of the retracting plunger mechanism 18.

Referring again to FIG. 4, a coiled compression spring 64 is disposed in the forward end of the major portion 24 of the axial bore 22. The front end of the coiled spring 64 is positioned so as to abut against the intermediate wall 28 of the axial bore 22 for biasing the writing cartridge 20 toward the rear end 16 of barrel portion 12, while the opposed end of the coiled spring 64 is maintained against a plurality of protuberances 66 formed intermediate the writing cartridge 20. Additionally, the coiled spring 64 and the cartridge end 56 cooperate with the elongated projection 54 on the retractor mechanism 18 in such a manner so as to maintain the retracting plunger mechanism 18 in a position corresponding to the writing cartridge 20 being protracted, by imparting a moment, or force, upon the plunger mechanism 18. The moment, or force, acts generally perpendicular to the longitudinal axis of the barrel portion 12 and causes the front end 50 of the clip portion 46 to be biased toward the barrel portion 12 of the writing instrument 10.

Turning now to FIGS. 4 and 6, in using the writing instrument 10, the cartridge 20 is moved from its retracted position of FIG. 4, to a protracted position illustrated in FIG. 6, by depressing the push button portion 52 on the body portion 44 of the retracting plunger mechanism 18 in the direction of arrow "A". Upon depressing the retracting plunger mechanism 18, the coiled spring 64 becomes compressed against the intermediate wall 28 of the bore 22 adjacent the front end 14 of barrel portion 12. Once moved into the protracted position, the latching detent 48 of the clip portion 46 becomes engaged in the locking slot 42 and is maintained therein by the moment, or force, imparted by the distal end 56 of the writing cartridge 20 in cooperation with coiled spring 64 on the projection 54 of retractor mechanism 18.

To retract the cartridge 20 into the front end 14 of the barrel portion 12, the rear end 63 of the clip portion 46 of retracting plunger 18 may be depressed in the direction of arrow "B" so as to pivot the plunger mechanism 18 about the opposed notches 60 of transverse wall 58. Thereupon, the front end 50 of clip portion 46 pivots away from the barrel portion 12, causing the latching detent 48 thereof to disengage the locking slot 42. Consequently, the coiled spring 64 decompresses, forcing the writing cartridge 20 rearward, and concurrently causing the plunger mechanism 18 to advance rearwardly until such a time as the rear wall 68 of the clip portion 46 abuts against the trailing edge 40 of mounting slot 30. Alternatively, the latching detent 48 may be disengaged from the locking slot 42 by placing the writing instrument 10 into a shirt pocket to automatically retract the writing cartridge 20. More particularly, the writing instrument 10 may be placed into a shirt pocket so that the pocket material forces the front end 50 of clip portion 46 away from barrel portion 12 to disengage the latching detent 48 from locking slot 42.

Figure 7:
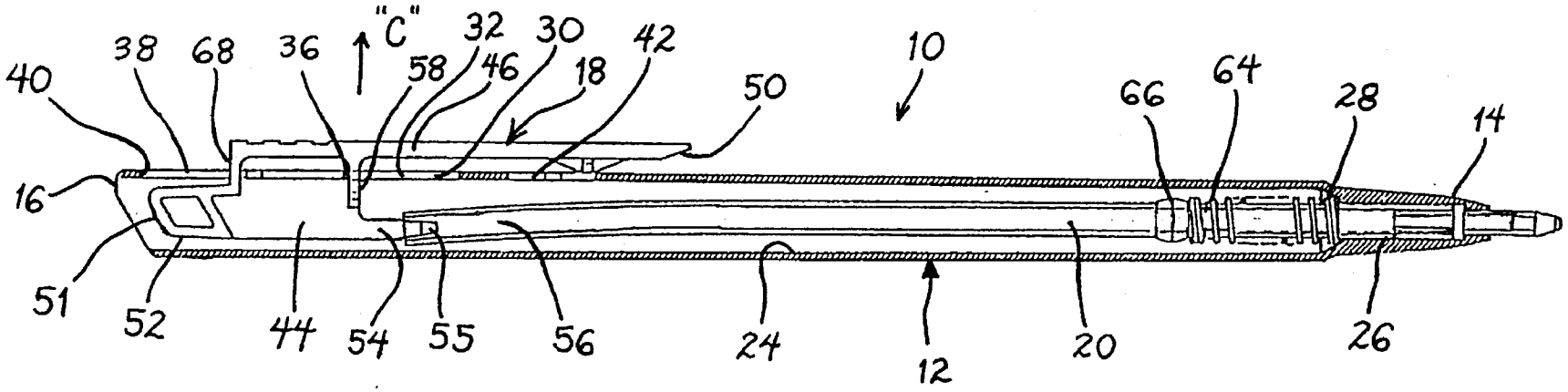
FIG. 7 is a side cross-sectional view of the writing instrument of FIG. 1, with the retractor mechanism in a position to facilitate removal of the writing cartridge from the barrel portion.

Turning now to FIG. 7, in order to replace a spent writing cartridge the retracting plunger mechanism 18 can be easily removed by advancing the retractor mechanism forwardly. The forward advancement is terminated when the transverse wall 58 of body portion 44 is in registration with the notched section 36 adjacent the dismounting area 32 defined within the mounting slot 30. In this position, the clip portion 46 of the retractor mechanism 18 is substantially parallel to the longitudinal axis of the barrel portion 12 of writing instrument 10. At such a time, the end 51 of push button 52 is clear of trailing edge 40 and the retracting plunger mechanism 18 may be lifted in the direction of arrow "C" so as to dismount the retracting plunger mechanism 18 from the barrel portion 12. As the retractor mechanism 18 is lifted from the barrel portion 12, the forwardly extending projection 54 and cartridge end 56 exit the barrel portion 12 through the forward dismounting area 32 defined in mounting port 30. Once removed, the rear end portion 56 of the writing cartridge 20 may be disengaged from the tapered end 55 of the projection 54. Subsequently, a new writing cartridge may be engaged with the retractor mechanism 18 and the writing instrument 10 may be reassembled.

The mounting of the retracting plunger mechanism 18 within the mounting port 30 is accomplished by extending the body portion 44 thereof into the rearward mounting area 38 of mounting slot 30. The body portion 44 is positioned in such a manner so that the area of the barrel portion 12 which comprises the periphery of mounting slot 30 is engaged in the opposed notches 60 formed in the transverse wall 58 of body portion 44.

While the invention has been shown and described with respect to a preferred embodiment, it will be understood by those skilled in the art that various modifications may be made therein without departing from the spirit and scope of the invention.

What is claimed is:

1. Writing instrument which comprises:

a) a barrel portion defining a longitudinal axis;

b) a replaceable cartridge housed in said barrel portion and defining a front end portion and a rear end portion, the front end portion of said cartridge being maintained substantially coaxial with said barrel portion;

c) retractor means removably maintained in a rear end of said barrel portion and adapted for axial movement between a first position corresponding to said cartridge being retracted within a front end of said barrel portion and a second position corresponding to said cartridge being protracted from said front end of said barrel portion; and d) spring means disposed in said front end of said barrel portion for urging said cartridge toward said rear end of said barrel portion;

said retractor means maintaining the rear end portion of said cartridge in a deflected position spaced from the longitudinal axis of said barrel portion so as to generate a biasing force acting upon said retractor means when said retractor means is in either of said first position and said second position, whereby said spring means and the rear end portion of said cartridge being in said deflected position with respect to said longitudinal axis cooperate to impart a moment force on said retractor means with respect to said longitudinal axis to retain said retractor means in said second position.

2. Writing instrument as recited in claim 1, wherein said biasing force acts substantially perpendicular to the longitudinal axis of said barrel portion.

3. Writing instrument as recited in claim 1, wherein said retractor means comprises a body portion, a clip portion depending from said body portion and latch means provided on said clip portion.

4. Writing instrument as recited in claim 3, wherein said clip portion is monolithically formed with said body portion.

5. Writing instrument as recited in claim 3, wherein said latch means comprises a detent formed adjacent an end of said clip portion.

6. Writing instrument as recited in claim 1, wherein said body portion of said retractor means includes means for engaging said rear end portion of said replaceable cartridge.

7. Writing instrument as recited in claim 6, wherein said engaging means comprises a projection depending from said body portion of said retractor means.

8. Writing instrument as recited in claim 3, wherein said barrel portion includes an aperture for engaging said latch means when said retractor means is in said second position.

9. Writing instrument as recited in claim 3, wherein said barrel portion includes a longitudinally extending port for removably mounting said retractor means.

10. Writing instrument as recited in claim 9, wherein said longitudinally extending port is dimensioned and configured in such a manner so as to permit both axial and pivotal movement of said retractor means relative to said barrel portion.

11. Writing instrument which comprises:

a) a barrel portion defining a longitudinal axis;

b) a replaceable cartridge housed in said barrel portion and defining a front end portion in substantial alignment with said longitudinal axis and a rear end portion;

c) spring means disposed in a front end of said barrel portion for urging said cartridge toward a rear end of said barrel portion;

d) retractor means removably maintained in said rear end of said barrel portion and adapted for pivotal movement with respect to said longitudinal axis and axial movement between a first position corresponding to said cartridge being retracted within said front end of said barrel portion and a second position corresponding to said cartridge being protracted from said front end of said barrel portion, said retractor means including:

i) a body portion at least partially disposed in said barrel portion;

ii) a clip portion depending from said body portion disposed substantially exterior to said barrel portion;

iii) latch means provided on said clip portion for engaging an area of said barrel portion to retain said retractor means in said second position; and iv) means for maintaining the rear end portion of said cartridge in a deflected position spaced from the longitudinal axis of said barrel portion when said retractor means is in either of said first position and said second position, said means for maintaining and said spring means cooperating to generate a biasing force acting upon said retractor means, whereby said spring means, said deflected rear end portion of the cartridge and said maintaining means cooperate to impart a moment force on said retractor means with respect to said longitudinal axis to pivot said retractor means with respect to said longitudinal axis to cause said latch means to engage said barrel portion to retain said retractor means in said second position.

12. Writing instrument as recited in claim 11, wherein said biasing force acts substantially perpendicular to the longitudinal axis of said barrel portion.

13. Writing instrument as recited in claim 11, wherein said latch means comprises a detent formed adjacent an end of said clip portion for engaging an aperture provided in said barrel portion when said retractor means is in said second position.

14. Writing instrument as recited in claim 11, wherein said barrel portion includes a longitudinally extending port defined therein for removably mounting said retractor means, said port being dimensioned and configured in such a manner so as to permit both axial and pivotal movement of said retractor means relative to said barrel portion.

15. Writing instrument which comprises:

a) a barrel portion for housing a replaceable cartridge;

b) retractor means removably maintained in a rear end of said barrel portion and adapted for pivotal movement with respect to an axial centerline of said barrel portion and axial movement between a first position corresponding to said cartridge being retracted within a front end of said barrel portion and a second position corresponding to said cartridge being protracted from said front end of said barrel portion, at least a portion of said retractor means engaging said barrel portion when in said second position to retain said retractor means in said second position, said retractor means including:

i) a projecting member extending from a body portion of said retractor means for engaging a rear end portion of said replaceable cartridge to maintain said rear end portion of said cartridge in a deflected position spaced from an axial centerline of said barrel portion so to generate a biasing force which acts upon said retractor means; and c) spring means for urging said replaceable cartridge toward said rear end of said barrel portion, said spring means cooperating with said deflected rear end portion of said cartridge and said projecting member to pivot said retractor means to permit said portion of said retractor means to engage said barrel portion to retain said retractor means in said second position.

16. Writing instrument as recited in claim 15, wherein said biasing force acts substantially perpendicular to the axial centerline of said barrel portion.

17. Writing instrument as recited in claim 15, wherein said retractor means further comprises a clip portion extending from said body portion, and said portion which engages said barrel portion comprises a latch means provided on said clip portion.

18. Writing instrument as recited in claim 17, wherein said latch means comprises a detent formed adjacent an end of said clip portion for engaging an aperture provided in said barrel portion when said retractor means is in said second position.

19. Writing instrument as recited in claim 15, wherein said barrel portion includes a longitudinally extending port defined therein for removably mounting said retractor means, said port being dimensioned and configured in such a manner so as to permit both axial and pivotal movement of said retractor means relative to said barrel portion.

* * * * *